United States Patent [19]

Garelick

[11] 4,298,016

[45] Nov. 3, 1981

[54] LOCKING MECHANISM FOR FOLDABLE WALKER

[75] Inventor: Herbert J. Garelick, Saint Paul, Minn.

[73] Assignee: Garelick Mfg. Co., Saint Paul Park, Minn.

[21] Appl. No.: 161,674

[22] Filed: Jun. 23, 1980

[51] Int. Cl.[3] ..... A61H 3/00

[52] U.S. Cl. ..... 135/67; 135/74

[58] Field of Search ..... 135/67, 74; 272/70.3, 272/70.4; 280/289 R, 289 L, 200, 38, 39, 87.02 W; 297/5, 6; 248/155.4, 150, 166, 167, 434; D3/5, 7

[56] References Cited

U.S. PATENT DOCUMENTS

| | | | |
|---|---|---|---|
| 139,125 | 5/1873 | Doherty . | |
| 179,519 | 7/1876 | Cameron . | |
| 188,414 | 3/1877 | Rohde . | |
| 266,606 | 10/1882 | Cannon . | |
| 540,875 | 6/1895 | Price . | |
| 711,322 | 10/1902 | Kaufman . | |
| 806,343 | 12/1905 | Haver . | |
| 1,148,877 | 8/1915 | Walter . | |
| 1,238,871 | 9/1917 | Bartran . | |
| 1,406,468 | 2/1927 | McCollum . | |
| 1,707,511 | 4/1929 | Cornwell . | |
| 1,776,198 | 9/1930 | Russ et al. . | |
| 1,876,446 | 9/1932 | Boenning . | |
| 1,893,195 | 1/1933 | Boenning . | |
| 1,933,164 | 10/1933 | Corporon | 45/11 |
| 2,020,014 | 11/1935 | Boenning | 311/98 |
| 2,270,217 | 1/1942 | North | 311/98 |
| 2,567,417 | 9/1951 | Adler | 311/99 |
| 2,796,916 | 6/1957 | Womble | 135/67 |
| 2,817,387 | 12/1957 | Blake | 155/22 |
| 2,902,325 | 9/1959 | Knoblock et al. | 311/37 |
| 2,996,070 | 8/1961 | Ries | 135/67 |
| 3,442,276 | 5/1969 | Edwards et al. | 135/45 |
| 3,688,789 | 9/1972 | Bunch | 135/67 |
| 3,945,389 | 3/1976 | Smith | 135/67 |
| 3,993,088 | 11/1976 | Thomas | 135/67 |
| 4,180,086 | 12/1979 | Thomas | 135/67 |

*Primary Examiner*—J. Karl Bell

*Attorney, Agent, or Firm*—Mark W. Gehan

[57] ABSTRACT

A foldable walker is described which includes a bridge member comprising an elongated rod which is mounted at its first end to a side member of the walker and received at its second end through an aperture in a locking member carried on the front of the walker. The elongated rod has a recessed portion near its second end. The locking member is adapted to receive the second end of the elongated rod and engage or selectively dis-engage said rod in response to movement of a button member at the top of the locking member.

9 Claims, 5 Drawing Figures

LOCKING MECHANISM FOR FOLDABLE WALKER

TECHNICAL FIELD

This invention relates to improvements in apparatus useful as a walking aid. More particularly, this invention relates to improvements in foldable walkers.

BACKGROUND OF THE INVENTION

Although foldable walkers have been known for many years, there has not heretofore been suggested a foldable walker having simple and effective locking means for maintaining the walker in open position when used and permitting the walker to be readily folded for storage or transport. Other foldable walkers have been described, for example, in U.S. Pat. Nos. 2,996,070 and 3,945,389.

SUMMARY OF THE INVENTION

In accordance with the present invention there is provided an improvement in foldable walkers of the type having a pair of side members each pivotally connected to a front member and having a bridging member extending from each side member to the front member. The improvement comprises a bridge member comprising an elongated rod which is mounted at its first end to the side member and received at its second end through an aperture in a locking member carried on the front member. The elongated rod has a recessed portion near its second end. The locking member comprises a housing having a transverse aperture extending through it which receives the second end of the elongated rod. The housing is held to the front member by means of a mounting stem which is affixed to the front member. A button member having a transverse aperture extending therethrough is received in the housing and is movable between an outward position and an inward or depressed position. Bias means normally biases the button member to its outward position. The button member is adapted to engage the recessed portion of the elongated rod when the recessed portion is moved into the housing and is adapted to release the elongated rod when the button member is moved to its inward or depressed position.

BRIEF DESCRIPTION OF THE DRAWINGS

The invention is described in more detail hereinafter with reference to the accompanying drawings wherein like reference characters refer to the same parts throughout the several views and in which.

DETAILED DESCRIPTION OF THE INVENTION

Figure 1:
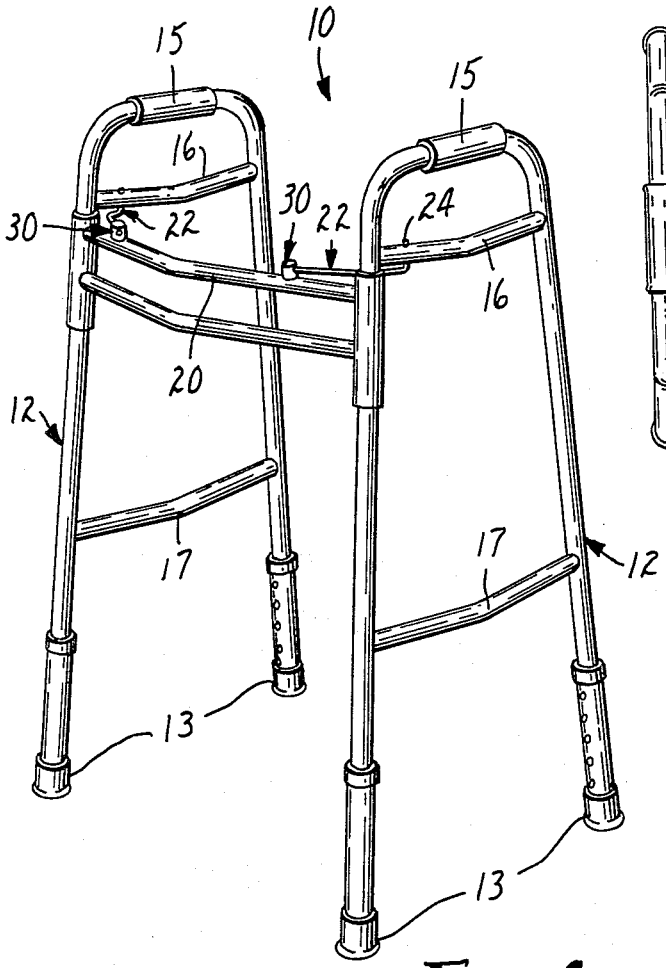
FIG. 1 is a perspective view of a foldable walker embodying the present invention.
Figure 4:
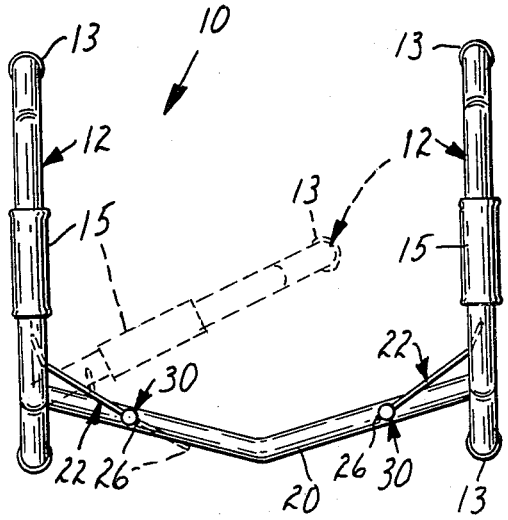
FIG. 4 is a top view of the foldable walker of FIG. 1, where the dotted lines show one of the side members in partially collapsed condition.

Thus, in FIGS. 1 and 4 there is shown a foldable walker 10 of the type having a pair of side members 12 which are connected to a front-member 20. Each side member 12 is U-shaped and has two feet 13 at its base and a grip portion 15 at its top. Strut members 16 and 17 connect the two legs of each side member to lend rigidity thereto. Each side member is pivotally connected to front member 20, for example, by means of a tubular bearing.

Bridging members 22 extend from each side member 12 to the front member 20. One end 24 of each bridging member 22 is connected to strut member 16 of side member 12, while the other end 26 is received through an aperture in locking member 30. The bridging member 22 is in the form of an elongated rod (preferably of circular cross-section which is uniform along its length) which has a notch or recessed portion 25 near its end 26. End 24 of rod 22 is received through an appropriate aperture in strut 16 and a clip 23 may be employed to prevent end 24 from slipping out of the aperture. A clip 23 may also be used on end 26 to prevent rod 22 from being inadvertently pulled out of locking member 30.

Figure 5:
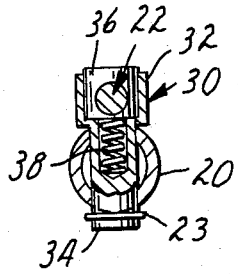
FIG. 5 is a cross-sectional view of the locking member shown in FIG. 4 when the button member is in its inward or depressed position and the side member is not in locked position.

Locking member 30 comprises a housing 32 which includes a mounting stem 34 which is received in an aperture in front member 20 and held in position by clip 23 on the bottom of the mounting stem. Button member 36 is received in the housing 32 and is movable between an outward position (shown in FIGS. 2 and 3) and an inward or depressed position (shown in FIG. 5). Bias means 38 (shown as a spring in FIGS. 2, 3 and 5) normally biases the button member 36 to its outward position. Preferably bias means 38 is contained within the housing and mounting stem, as shown in the drawings.

Figure 2:
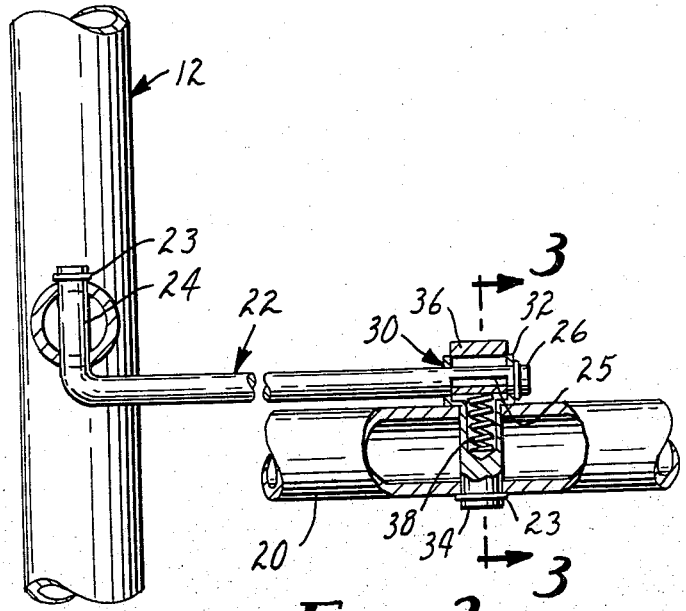
FIG. 2 is a partial cut-away view showing one end of the bridge member captured by the locking member.
Figure 3:
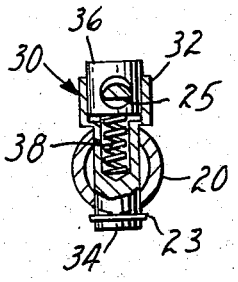
FIG. 3 is a cross-sectional view of the locking member of FIG. 2 taken along line 3—3.

Locking member housing 32 and button member 36 each has a transverse aperture therethrough so that end 26 of elongated rod 22 may be received in locking member 30. When the notched or recessed portion 25 of rod 22 is moved into housing 32 (i.e. when the side member is moved to its open position), bias means 38 forces button member 36 outwardly, whereupon the lower portion of button member 36 moves into and engages recessed portion 25 and thereby holds rod 22 securely in that position (as shown in FIGS. 2 and 3).

Preferably housing 32 is cup-shaped and has a cylindrical cavity in which to receive the button member 36 (which is also preferably cylindrically shaped). When the elongated rod 22 is circular in cross-section, the apertures in the housing and the button member are also preferably circular and of only slightly greater diameter than rod 22 so as to minimize slack and play between rod 22 and locking member 30.

When button member 36 is moved to its inward or depressed position it is disengaged from notch 25 in rod 22 so that rod 22 may move through locking member 30 unimpeded as the side member 12 is folded inwardly toward front member 20 (as shown in FIG. 4). When the side member 12 is moved to its open position, locking member 30 automatically engages notch 25 and thereby locks rod 22 into position. Mounting stem 34 and end 24 of rod 22 are free to pivot, as required, when side member 12 is moved between its open and collapsed positions. When side member 12 is in the collapsed position, rod 22 lies above, and parallel to, front member 20.

It will be readily apparent to those skilled in the art that other variants are possible within the scope of this invention.

What is claimed is:

1. In a foldable walker of the type having a pair of side members each pivotally connected to a front member and having a bridging member extending from each side member to said front member, wherein the improvement comprises a bridge member comprising an elongated rod which is mounted at its first end to said side member and received at its second end through an aperture in a locking member carried on said front member, said elongated rod having a recessed portion therein near its second end, said locking member comprising a housing having a transverse aperture therethrough, said housing including a mounting stem which is affixed to said front member, wherein a button member having a transverse aperture therethrough is received in said housing and is movable between an outward position and an inward position, wherein bias means normally biases said button member to said outward position, and wherein said button member is adapted to engage said recessed portion of said elongated rod when said recessed portion is moved into said housing and is adapted to release said elongated rod when said button member is moved to its inward position.

2. The improved walker of claim 1, wherein said housing is integral with said mounting stem.

3. The improved walker of claim 1, wherein said housing is cup-shaped.

4. The improved walker of claim 1, wherein said button is cylindrical.

5. The improved walker of claim 4, wherein said button is received in a cylindrical cavity in said housing.

6. The improved walker of claim 1, wherein said rod is circular in cross-section.

7. The improved walker of claim 6, wherein said apertures in said button member and housing are circular.

8. The improved walker of claim 7, wherein said transverse aperture in said button member and said transverse aperture in said housing are of the same diameter.

9. The improved walker of claim 1, wherein said elongated rod is round and has a uniform diameter along its length.

* * * * *